US005226459A

United States Patent [19]

De Ro et al.

[11] Patent Number: 5,226,459

[45] Date of Patent: Jul. 13, 1993

[54] THREAD BRAKE WITH FIXED AND ROTATABLE THREAD GUIDES

[75] Inventors: Ignace De Ro, Ieper; Hugo Markey, Langemark, both of Belgium

[73] Assignee: Picanol N.V. naamloze venootschap, Ieper, Belgium

[21] Appl. No.: 928,130

[22] Filed: Aug. 11, 1992

[30] Foreign Application Priority Data

Aug. 13, 1991 [BE] Belgium ..... 09100737

[51] Int. Cl.[5] ..... D03D 47/34

[52] U.S. Cl. ..... 139/450; 242/154

[58] Field of Search ..... 242/153, 154; 139/450, 139/194; 66/146, 145 R

[56] References Cited

U.S. PATENT DOCUMENTS 1,375,568 4/1921 Cunniff ..... 242/154
2,326,714 8/1943 Wholton .
2,618,445 11/1952 Buder .
3,330,304 7/1967 Hall .
3,408,832 11/1968 Abe et al. ..... 242/154 X
3,918,275 11/1975 Paepke ..... 242/154 X
4,010,915 3/1977 Strutz et al. .
4,513,792 4/1985 Lincke ..... 139/450 X

FOREIGN PATENT DOCUMENTS 2271162 12/1974 France .
465566 5/1937 United Kingdom ..... 242/154

*Primary Examiner*—Andrew M. Falik
*Attorney, Agent, or Firm*—Bacon & Thomas

[57] ABSTRACT

A thread brake includes a plurality of fixed thread guide elements, at least two movable thread guide elements mounted on a rotatable body which, through rotation, can be brought in opposite directions to cross a path of a thread being guided by the fixed thread guide elements and thereby engage the thread such that the thread is bent in two places, thereby braking the thread. Rotation of the movable thread guide elements may be restricted during braking by taps appropriately positioned.

11 Claims, 4 Drawing Sheets

THREAD BRAKE WITH FIXED AND ROTATABLE THREAD GUIDES

This invention concerns a thread brake, in particular a thread brake for weaving machines.

SUMMARY OF THE INVENTION

In general the thread brake of the invention can be used for different applications in weaving machines, but it is one particular objective of the invention to provide a device for braking weft threads which is positioned between the feed spool and the means with which the weft thread is inserted in the shed and which brakes the weft thread before it has reached the end of the shed, such that the risk that the weft thread breaks at the time its movement is blocked is small.

Another objective of the invention is to provide a thread brake which reacts very quickly, such that the weft thread is always braked at the right moment in each weaving cycle.

Yet another objective of the invention is to provide a thread brake with a very long life.

A still further objective of the invention is to provide a thread brake with a very compact construction.

These objectives are achieved by providing a thread brake which includes a number of fixed thread guide elements and at least two movable thread guide elements mounted on a rotatable body which, through rotation, can be brought in an opposite direction through the trajectory of a thread guided by the fixed thread guide elements, such that the thread is bent, in two places. Also included are means which restrict the rotation of the body during the braking, and drive means to rotate the body.

Preferably the body can rotate about a rotary shaft and the movable thread guide elements include pins which are mounted on the body at equal distances along either side of the rotary shaft. The drive means preferably includes an electromagnetic drive.

The thread brake according to the invention offers the advantage that the bearing of the rotatable body and of the drive means only has to absorb a small force thanks to the symmetrical load, such that there is little wear.

The thread brake also offers the advantage that even with a slight rotation a considerable braking force is offered, as two brake zones are provided.

Moreover, between the two brake zones, the invention provides a zone available to integrate other functions.

BRIEF DESCRIPTION OF THE DRAWINGS

In order to better explain the characteristics according to the invention, by way of example only and without being limitative in any way, the following preferred embodiments are described with reference to the accompanying drawings, in which.

DETAILED DESCRIPTION OF THE PREFERRED EMBODIMENTS

Figure 1:
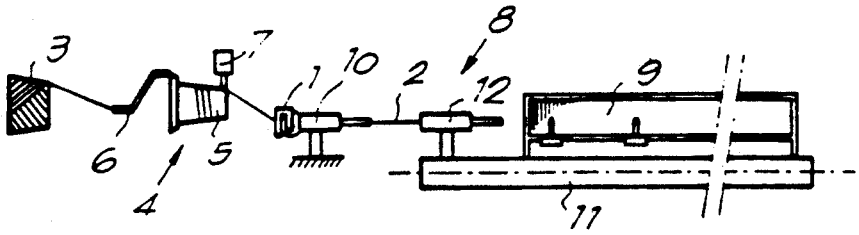
FIG. 1 is a schematic view showing a preferred thread brake according to the in a particular application.

FIG. 1 shows an arrangement of a thread brake 1 for braking a thread 2, in this case a weft thread of a weaving machine. As is known the thread 2 is unspooled from a feed spool 3, spooled in a prewinder 4 on a drum 5 by means of a winding tube 6, intermittently released from the drum 5 by means of an electromagnetically controlled blocking element 7 and inserted in the shed 9 of the weaving machine by insertion means 8. In the case of an airjet weaving machine, the insertion means 8 usually consist of a fixed auxiliary main nozzle 10 and a main nozzle 12 mounted on the sley 11 of the weaving machine.

The thread brake 1 is preferably mounted at the entry of the auxiliary main nozzle 10 in order to brake the thread 2 at the end of each insertion in the shed 9, such that the thread 2, as the blocking element 7 closes, is brought to a standstill in a less abrupt manner.

According to the invention the thread brake as represented in FIGS. 2 to 5 includes a number of fixed thread guide elements 13, 14, 15 and 16, at least two movable thread guide elements 18 and 19 mounted on a rotatable body 17, means 20 which restrict the rotation of the body 17 during the braking; and drive means 21 to rotate said body 17.

The fixed thread guide elements 13, 14, 15 and 16 are preferably placed in one straight line. In the example shown, the thread guide elements 13, 14 and 15 consist of thread eyes, whereas the thread guide element 16 is formed by the entry of the auxiliary main nozzle 10.

Figure 5:
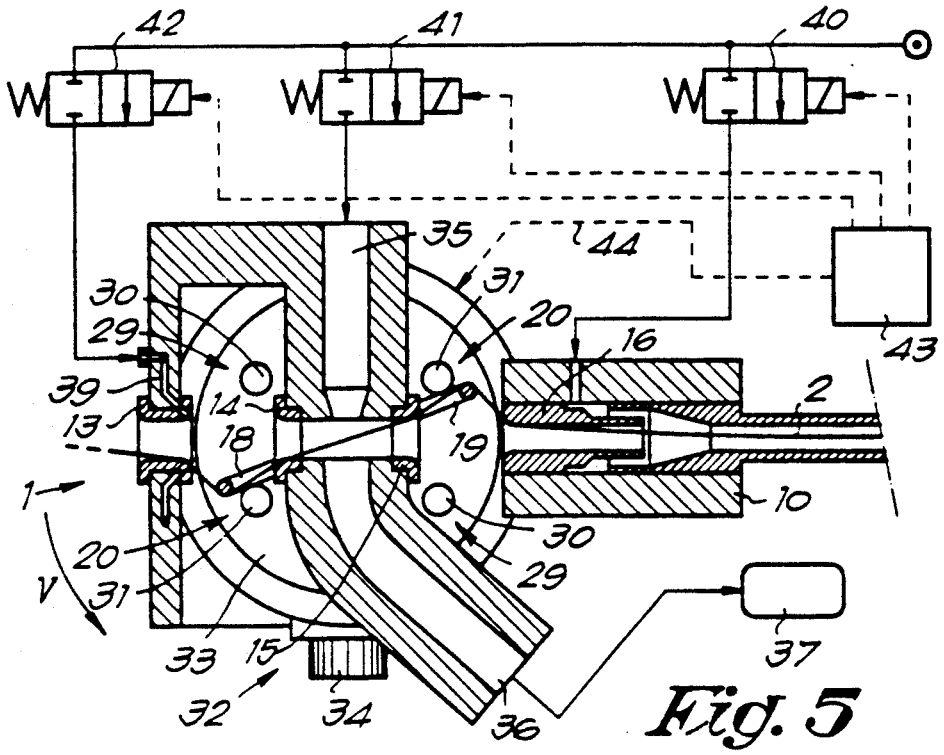
FIG. 5 shows the thread brake of FIG. 2, but in a different position.

Through rotation, the movable thread guide elements 18 and 19 can be moved in mutually opposite directions to pass through the path or trajectory of a thread 2 guided by the fixed thread guide elements 13–16, such that the thread 2, during the braking, as shown in the position from FIG. 5, is bent in two directions. To this end the movable thread guide elements 18 and 19 respectively can be moved between the fixed thread guide elements 13–14 and 15–16. It is clear that the same effect is obtained when the thread guide elements 14 and 15 are replaced by a common element.

Rotatable body 17 is mounted On a shaft 22 which is mounted in a rotatable manner in the housing 24 by means of bearings 23. The movable thread guide elements 18 and 19 preferably consist of pins, formed of folded threads, which are situated on either side of the rotary shaft 25 at equal distances.

Because of the symmetrical arrangement, the center of gravity of the body 17 and the thread guide elements 18 and 19 mounted on it coincides with the axis of rotation 25, which is advantageous in that no forces are created in the bearings 23 of the shaft 22 which are due to the accelerations and decelerations occuring during the rotation of body 17.

The rotary shaft 22 is mounted horizontally in the example shown, such that the dust which is created in the thread brake 1 can drop down and does not come into contact with the drive means 21.

The drive means 21 consist of an electrical drive, such as for example a metal or magnetic rotor 26 which is mounted on the shaft 22, and a solenoid 27 which forces the rotor 26 in a sense of rotation V as it is excited. Naturally, the drive means 21 can also consist of another electrical drive such as a stepping motor or a DC motor.

The thread brake 1 is also provided with drawback means, such as a drawback spring 28 which makes the body 17 turn back after the excitation of the drive means 21 has stopped. The drawback spring 28 forces the body 17 against a stopping means 29 which includes, for example two taps 30 which can cooperate with the respective thread guide elements 18 and 19.

The above-mentioned means 20 which restrict the rotation of the body 17 during the braking may for example also consist of two taps 31 which can cooperate with the respective thread guide elements 18 and 19.

Preferably the above-mentioned taps 30 and 31 are situated at equal distances from the axis of rotation 25 of the body 17, such that due to this arrangement no forces are created in the bearings 23 of the shaft 22 as the thread guide means 18 and 19 bump against said taps 30 and 31.

It is clear that according to a variant the above-mentioned means 20 and 29 which restrict a rotation of the body can also be provided at the height of the shaft 22 on which the body 17 is mounted or at the height of the rotor 26.

Preferably the thread brake 1 is provided with setting means 32 which allow alteration of the braking force of the thread brake 1. To this end at least the means 20, and, preferably also the stopping means 29 can be moved. To this end the taps 30 and 31 are mounted on a support 33 which can be rotated around the rotary shaft 22 and which is clamped in the required angle position by means of an adjusting screw 34.

Figure 2:
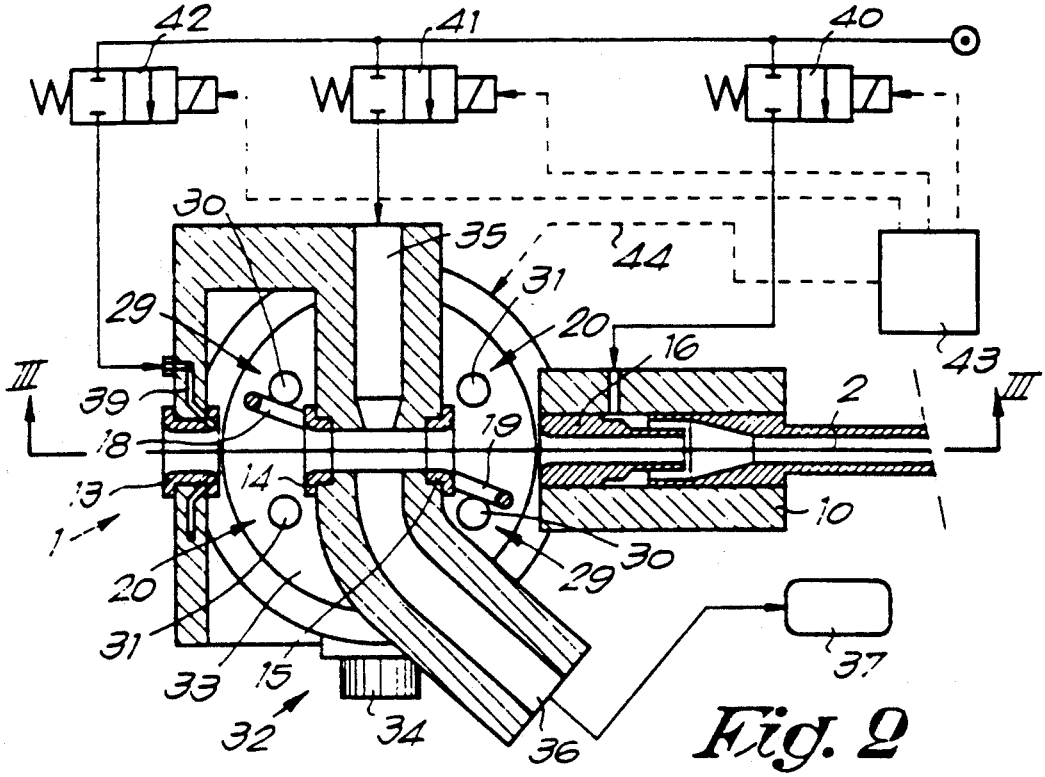
FIG. 2 shows a preferred thread brake in a front view and in a cross section.
Figure 3:
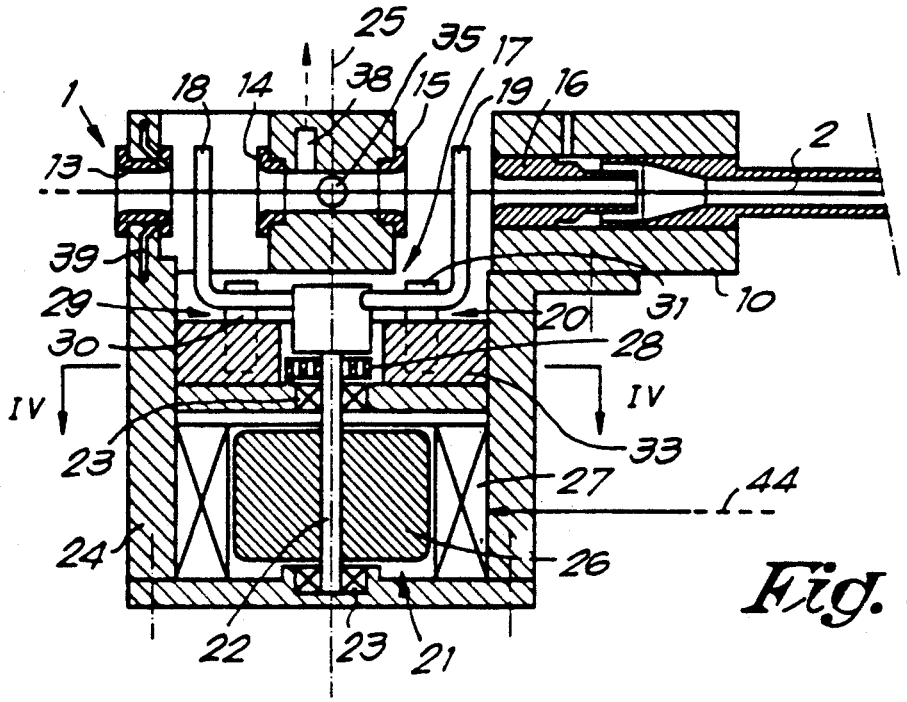
FIG. 3 shows a cross section according to line III—III in FIG. 2.
Figure 4:
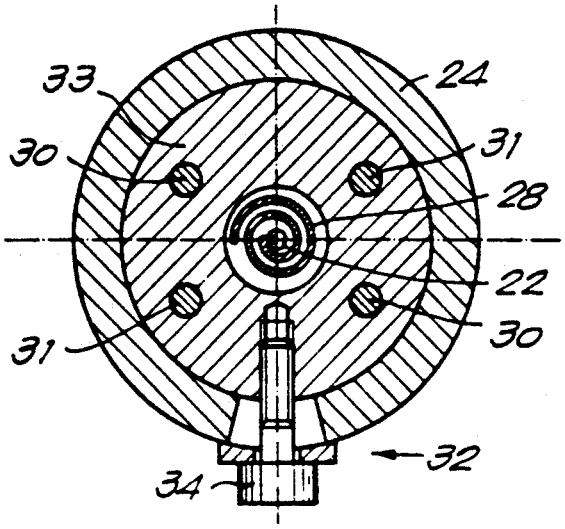
FIG. 4 shows a cross section according to line IV—IV in FIG. 3.

In the zone between the thread guide elements 14 and 15, as represented in FIGS. 2 and 3, a nozzle 35 can be provided to blow the thread 2 in a duct 36 if required. The duct 36 may be connected to a waste can 37 so as to carry off the thread 2.

It is known that a wrongly inserted weft thread 2 can be removed from the shed 9 by providing a connection for it to the feed spool 3 and by applying a procedure on it as described for example in U.S. Pat. No. 4.898.214. According to this procedure the thread 2 is tightened at the height of the insertion means 8. However, as the thread 2 may not break, the blocking element 7 is put out of its blocking position such that a winding thread 2 is released. In order to prevent this extra thread end from entering in the shed 9, a reversing nozzle is provided to keep the thread 2 taut. According to the present invention the function of the reversing nozzle is performed by the nozzle 35 which blows the thread 2 in the duct 36.

When weaving with several ducts and when switching over to one duct in case of a thread break, it is known that the thread should be removed from the main nozzle of the non-active duct after a while so as to prevent it from fraying and being blown in the shed. As is known from U.S. Pat. No. 4.998.567 use can be made to this end of a thread removal device. The function of such a device can be carried out according to the present invention by the nozzle 35 which blows the thread 2 into the duct 36, thus removing the thread from the main nozzle of the non-active duct.

In the above-mentioned zone a detector 38 can also be integrated which allows to check the presence of the thread 2.

At the height of the thread guide element 13 a threading nozzle 39 can be provided.

FIGS. 2 and 5 further show how the auxiliary main nozzle 10, the nozzle 35 and the threading nozzle 39 can be provided with compressed air by means of valves 40, 41 and 42 which are driven by means of a drive and control unit 43. Also the solenoid 27 is controlled by the unit 43 by means of a control line 44.

The working of the thread brake is described hereafter by means of FIGS. 2 and 5. In a state of rest the rotatable body 17 takes up a position as represented in FIG. 2, whereby the thread guide elements 18 and 19 are forced against the taps 30 with their bottom end by means of the drawback spring 28. In this position the thread 2 can pass freely through the thread brake 1.

At the end of each insertion the thread 2 is braked before being completely stopped by the blocking element 7. To this end the solenoid 27 is excited, as a result of which the body 17 rotates and takes up a position as represented in FIG. 5, whereby the bottom ends of the thread guide elements 18 and 19 make contact with the taps 31. Due to the bending around the thread guide elements 18 and 19 the thread 2 is braked. The braking force is determined by the set position of the taps 31, and not by the torque of the drive means 21. This torque is high so as to cause a very fast braking.

Figure 6:
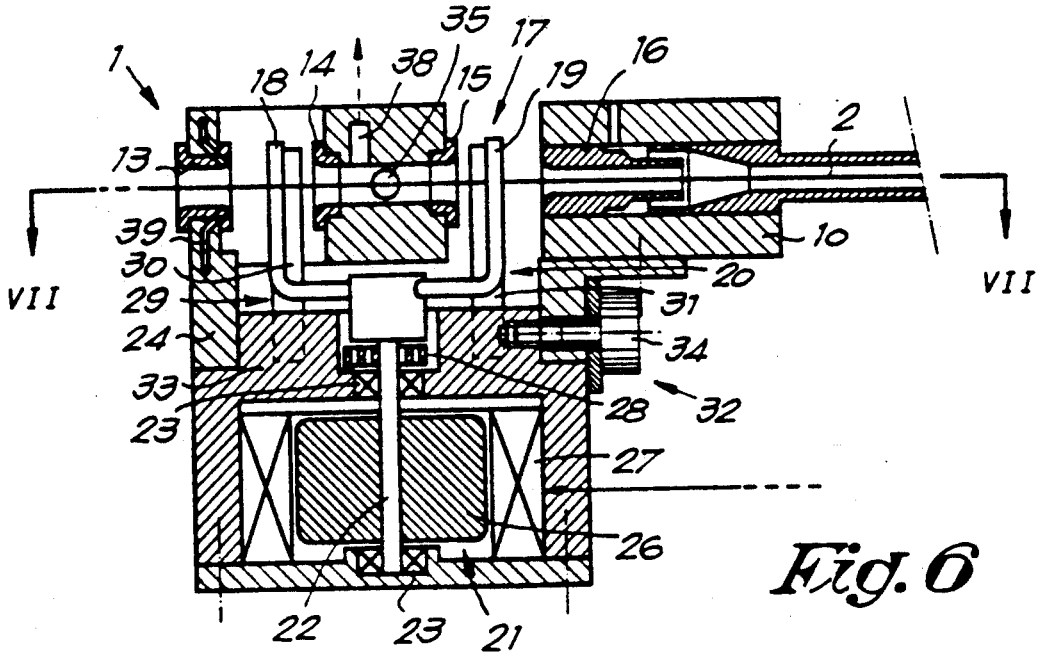
FIG. 6 shows a variant according to the invention.
Figure 7:
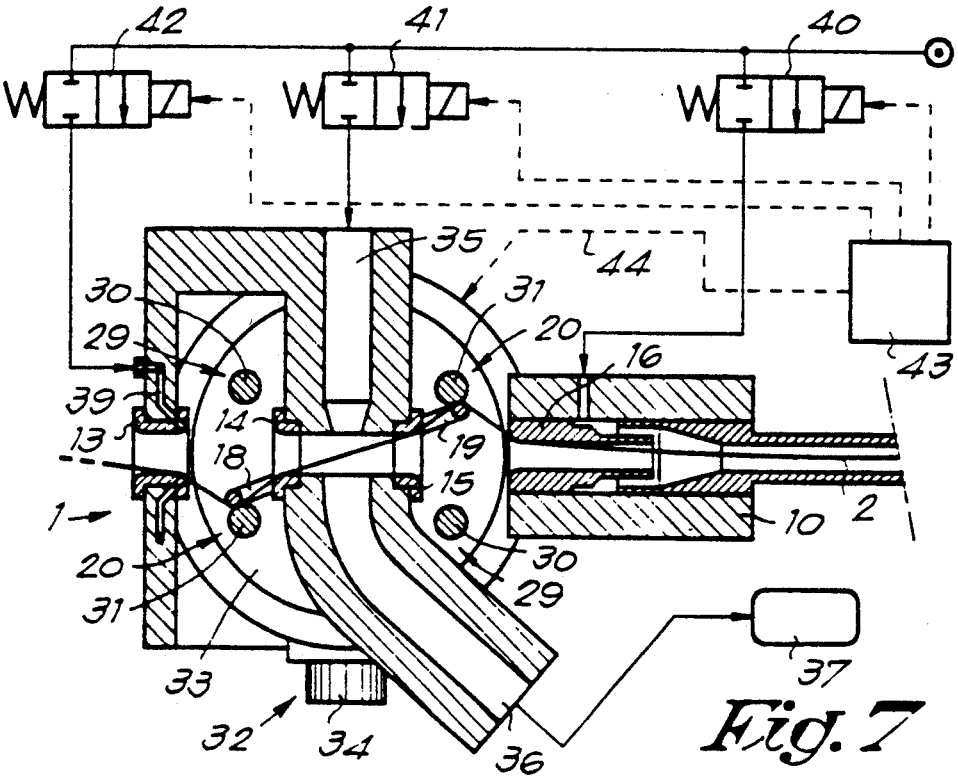
FIG. 7 shows a cross section according to line VII—VII in FIG. 6.

In the embodiment shown in FIGS. 2 to 5 the thread 2 is exclusively braked due to the bending along the thread guide elements 13, 18, 14, 15, 19 and 16. As shown in FIGS. 6 and 7 the taps 31 can also be placed such that the thread 2, as the thread brake 1 is excited, is also braked because it is clamped between the thread guide elements 18 and 19 and the taps 31. In the embodiment of FIGS. 6 and 7 the drive means 21 are integrated in the rotatable support 33. For clarity's sake, the adjusting screw 34 is represented in two different places in the views of FIGS. 6 and 7.

As those skilled in the art will appreciate based on the above description, the thread brake 1 can also be used in other than airjet weaving machines.

Furthermore, as will be appreciated by those skilled in the art, the above-mentioned element 17 can also be provided with several pairs rather than a single pair of the above-mentioned thread guide elements 18 and 19 which can be moved respectively between fixed thread guide elements. Thus, use can be made for example of six fixed thread guide elements placed in line and four movable thread guide elements, whereby each movable thread guide element can move between two fixed thread guide elements.

The present invention is therefore in no way limited to the embodiments described by way of example and shown in the accompanying drawings; on the contrary, such a thread brake can be made in various forms and dimensions while still remaining within the scope of the invention.

We claim:

1. A thread brake, comprising: a rotatable body; at least two movable thread guide elements mounted on the rotatable body; fixed guide means including a plurality of fixed thread guide elements for guiding a thread along a path through the thread brake; drive means for rotating the rotatable body to cause said two movable thread guide elements to pass through the path of the thread and thereby brake and thread by engaging the thread such that the thread is respectively bent in two places by the two movable thread guide elements; control means for controllably causing the drive means to rotate the rotatable body; and rotation restricting means for restricting rotation of said body to stop movement of said movable thread guide elements at a predetermined position.

2. A thread brake as claimed in claim 1, wherein said plurality of fixed thread guide elements comprises at least three fixed thread guide elements, and wherein said movable thread guide elements comprise pins and means for mounting the pins to move between two of said at least three fixed thread guide elements.

3. A thread brake as claimed in claim 1, wherein said rotatable body is mounted in a rotatable shaft, and said movable thread guide elements are positioned at equal distances from the rotatable shaft.

4. A thread brake as claimed in claim 1, wherein said rotatable body is mounted in a rotatable shaft, and said motion restricting means comprises taps positioned at equal distances from the rotatable shaft.

5. A thread brake as claimed in claim 1, wherein said drive means comprises an electrical drive.

6. A thread brake as claimed in claim 1, further comprising stopping means for positioning said movable guide elements at a position outside of the path of the thread, and drawback means for causing said body to move said movable guide elements against said stopping means.

7. A thread brake as claimed in claim 6, wherein said rotatable body is mounted on a rotatable shaft, and said stopping means comprises taps positioned at equal distances from the rotatable shaft.

8. A thread brake as claimed in claim 1, further comprising setting means for setting a braking force by altering a position of the rotation restricting means.

9. A thread brake as claimed in claim 1, further comprising means including a nozzle and a duct positioned between the movable thread guide elements for removing threads from said thread brake.

10. A thread brake as claimed in claim 1, further comprising a threading nozzle.

11. A thread brake as claimed in claim 1, further comprising means for positioning said movable thread guide elements to engage said rotation restricting means and clamp the threads therebetween during braking.

* * * * *